US009957847B2

(12) United States Patent
Beerens et al.

(10) Patent No.: US 9,957,847 B2
(45) Date of Patent: May 1, 2018

(54) METHOD FOR MANUFACTURING A SLIDING TAPPET

(71) Applicant: Mahle International GmbH, Stuttgart (DE)

(72) Inventors: Christoph Beerens, Stuttgart (DE); Gerhard Bucher, Eppingen (DE); Justus Himstedt, Stuttgart (DE); Kurt Maier, Leonberg (DE); Harald R. Mueller, Ostfildern (DE); Reinhard Rose, Fellbach (DE); Christoph Steinmetz, Ludwigsburg (DE)

(73) Assignee: Mahle International GmbH (DE)

( * ) Notice: Subject to any disclaimer, the term of this patent is extended or adjusted under 35 U.S.C. 154(b) by 134 days.

(21) Appl. No.: 14/821,016

(22) Filed: Aug. 7, 2015

(65) Prior Publication Data

US 2016/0040562 A1 Feb. 11, 2016

(30) Foreign Application Priority Data

Aug. 8, 2014 (DE) ..... 10 2014 215 784

(51) Int. Cl.
*F01L 1/14* (2006.01)
*F01L 1/16* (2006.01)
(Continued)

(52) U.S. Cl.
CPC ..... *F01L 1/16* (2013.01); *C23C 4/06* (2013.01); *C23C 4/129* (2016.01); *C23C 4/18* (2013.01);
(Continued)

(58) Field of Classification Search
CPC ..... F01L 1/16; F01L 2101/00; F01L 2103/00; C23C 4/12; C23C 4/06; C23C 4/18; C23C 4/129
(Continued)

(56) References Cited

U.S. PATENT DOCUMENTS 5,702,769 A 12/1997 Peters
5,993,978 A * 11/1999 Kim ..... F01L 1/14 428/553
(Continued)

FOREIGN PATENT DOCUMENTS

DE 60005416 T2 6/2004
DE 102008017029 A1 10/2009
(Continued)

OTHER PUBLICATIONS

Sarababda et al., Slide Component and Method for Production of Cladding on a Substrate, US Patent Application Pub. US 2014/0220380 A1, Aug. 7, 2014.*
(Continued)

*Primary Examiner* — Ching Chang
(74) *Attorney, Agent, or Firm* — Fishman Stewart PLLC

(57) ABSTRACT

A method for manufacturing a sliding tappet of a valve train of an internal combustion engine may include the steps of: providing a main body; applying a coating at least on a contact surface of the main body configured for contacting an associated cam. The coating may include tungsten carbide and cobalt, and the coating may be applied via high velocity oxygen fuel spraying. The method may further include the step of performing a surface finishing on the coating after the coating is applied.

16 Claims, 1 Drawing Sheet

(51) Int. Cl.
*C23C 4/06* (2016.01)
*C23C 4/18* (2006.01)
*C23C 4/129* (2016.01)

(52) U.S. Cl.
CPC ..... *F01L 2101/00* (2013.01); *F01L 2103/00* (2013.01); *F01L 2820/01* (2013.01)

(58) Field of Classification Search
USPC ..... 123/90.48, 90.51
See application file for complete search history.

(56) References Cited

U.S. PATENT DOCUMENTS

| | | | | |
|---|---|---|---|---|
| 6,004,372 | A | 12/1999 | Quets | |
| 6,109,138 | A * | 8/2000 | Upton | B26B 9/00 30/350 |
| 8,002,469 | B2 * | 8/2011 | Woydt | C23C 4/02 384/13 |
| 2013/0040065 | A1 | 2/2013 | Sato et al. | |

FOREIGN PATENT DOCUMENTS

| | | | |
|---|---|---|---|
| DE | 102010001283 | A1 | 9/2011 |
| DE | 112010003559 | T5 | 9/2012 |
| EP | 0725158 | A1 | 8/1996 |
| EP | 1895181 | A2 | 3/2008 |
| EP | 2397572 | A1 | 12/2011 |
| EP | 2730810 | A1 | 5/2014 |
| JP | 10088311 | | 4/1998 |
| JP | 10088312 | | 4/1998 |

OTHER PUBLICATIONS

Ma et al., Casting Molds Coated for Surface Enhancement and Methods of Making, US Patent Application Pub. US 2008/0093047 A1, Apr. 24, 2008.*
English abstract for DE-102008017029.
English abstract for JP-10088331.
English abstract for JP-10088312.

* cited by examiner

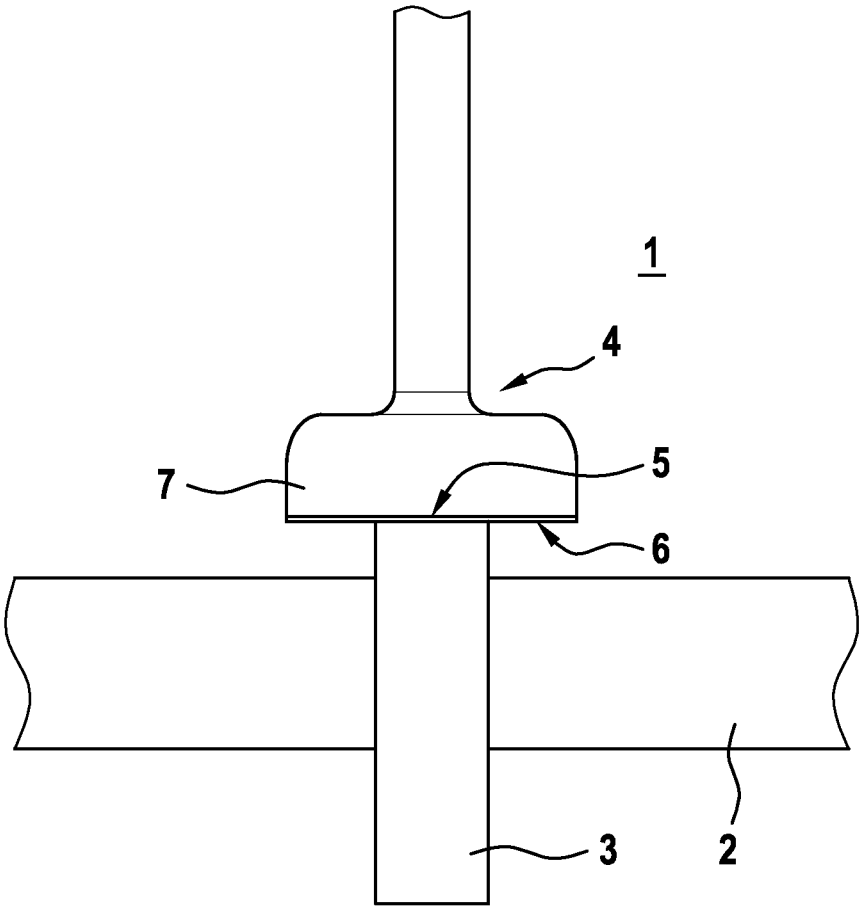
1
4
5
7
6
3
2

METHOD FOR MANUFACTURING A SLIDING TAPPET

CROSS-REFERENCE TO RELATED APPLICATIONS

This application claims priority to German Patent Application Number 10 2014 215 784.6 filed on Aug. 8, 2014, the contents of which are hereby incorporated by reference in its entirety.

TECHNICAL FIELD

The present invention relates to a method for manufacturing a sliding tappet of a valve train of an internal combustion engine. The invention also relates to a sliding tappet manufactured according to this method and to an internal combustion engine having at least one such sliding tappet.

BACKGROUND

From JP 10088311 A it is known to apply a wear-resistant coating from a material comprising carbide and cobalt by means of high velocity oxygen fuel spraying.

From JP-10-88312 A it is known to use a high velocity oxygen fuel spraying method for applying a suitable coating onto piston rings.

Valve tappets, which can be designed as roller tappets or as sliding tappets, are usually used for actuating intake and exhaust valves in internal combustion engines. In the case of sliding tappets, the transmission of force takes place by means of sliding contact, which is the reason why the contact surface has to be particularly wear-resistant. For this purpose, high-strength surfaces and materials are currently used, wherein it is typical nowadays for a sliding tappet to have a sintered carbide or ceramic plate inserted in a main body of the tappet. Through this, the surface directly in sliding/frictional contact is high-strength, whereas the remaining sliding tappet can be made from an inexpensive material and in particular also from a softer material. However, such carbide or ceramic plates can be brittle and therefore can only be used locally.

SUMMARY

The present invention is concerned with the problem of proposing a method for manufacturing a sliding tappet, by means of which an extremely wear-resistant sliding tappet can be manufactured in a cost-effective manner.

This problem is solved according to the invention by the subject matter of the independent claims. Advantageous embodiments are subject matter of the dependent claims.

The present invention, for a method for manufacturing a sliding tappet of a valve train of an internal combustion engine, is based on the general idea to first apply a coating comprising tungsten carbide and cobalt on a contact surface of the sliding tappet. This coating is applied by means of high velocity oxygen fuel spraying and is finished after spraying. In the process of this, the coating is reduced to a maximum layer thickness of 150 μm. During high velocity oxygen fuel spraying, continuous combustion of fuel takes place under high pressure within the combustion chamber, wherein the high pressure of the combusting fuel-oxygen mixture generated in the combustion chamber is passed through a downstream expansion nozzle, where the necessary high velocity of the gas jet is generated. Then, tungsten carbide and cobalt as powered spray materials are added to the high-velocity gas so that the spray materials are shot at high velocity onto the surface to be coated of the sliding tappet. High velocity oxygen fuel spraying enables to produce very dense coatings with excellent adhesion properties. By means of the controllable and just sufficient heat input, the spray material is not, or only insignificantly, metallurgically changed. With the method according to the invention it is possible to provide a relatively inexpensive main body of a sliding tappet made from a soft material, for example steel, with the above-described wear-resistant coating, which coating, moreover, is shaped in such a manner that it withstands the high load of the sliding contact between the cam and the sliding tappet. This requires that the coating has a certain surface quality and a required thickness. For this reason, the coating is first applied with a greater thickness during high velocity oxygen fuel spraying and is subsequently reduced to the required layer thickness by means of finish machining. This makes it possible to meet the tolerances for the valve train to provide only a layer thickness that is absolutely necessary for the function.

In an advantageous refinement of the method according to the invention, the coating is finished by lapping. Lapping is a material-removing mechanical manufacturing process for smoothing surfaces, in particular for reducing surface roughness. Lapping is machining process using a paste or liquid containing loosely distributed grains, the lapping compound, which is mostly applied on a counterpart that has a mating shape and preferably creates unsystematic cutting paths of the individual grains. In contrast to grinding, where the abrasive grain is firmly bonded, for example on an abrasive cloth, lapping operates with loose rolling grain. Thereby, very high surface qualities can be achieved even with a relatively large grain size, due to the minor material removal. However, it is important that the grain size of the abrasive is approximately homogenous since otherwise individual larger grains can cause relative deep scratches. In contrast to grinding, lapping is a process that removes material in multiple directions. Such a lapping process is particularly suitable for machining hard surfaces such as a tungsten carbide or cobalt coating.

In an advantageous refinement of the solution according to the invention, the sliding tappet is blasted prior to applying the coating. Blasting the surface to be coated cleans the surface and increases the roughness and thus improves the adhesion of the coating to be applied. $SiO_2$ or corundum can be used as blasting material, for example.

Furthermore, the present invention is based on the general idea of manufacturing a sliding tappet using such a method, wherein the coating provided for this is composed of approx. 80 to 90% by weight of tungsten carbide and approx. 10 to 20% by weight of cobalt.

A coating exhibiting the aforementioned weight percentages of tungsten carbide and cobalt has the following advantages: Up to high temperatures, there is minimal abrasive wear, high hardness and compression strength, which is a requirement for use in the tribologically highly stressed sliding contact zone.

In another advantageous embodiment of the solution according to the invention, the coating has a surface roughness of $Rz<2.0$. Since the surface roughness is a particularly relevant parameter with respect to sliding contact and also with respect to wear during a sliding contact, it is desirable to keep the surface roughness as low as possible. Lapping as a finishing process as described in the preceding paragraphs can be set to such a low surface roughness so that sliding of the sliding tappet on the cam with particularly low wear can be achieved.

Further important features and advantages of the invention arise from the sub-claims, from the drawings and from the associated description of the FIGURES based on the drawings.

It is to be understood that the above-mentioned features and the features still to be explained hereinafter are usable not only in the respective mentioned combination, but also in other combinations or alone, without departing from the context of the present invention.

A preferred embodiment of the invention is illustrated in the drawing and is explained in greater detail in the following description.

BRIEF DESCRIPTION OF THE DRAWINGS

The sole FIG. 1 shows a sliding tappet according to the invention in a side view.

DETAILED DESCRIPTION

According to FIG. 1, an internal combustion engine 1 comprises a camshaft 2 which is in sliding contact with a sliding tappet 4 via a cam 3. Through the sliding tappet 4, in turn, a non-illustrated valve, for example an intake valve or an exhaust valve of the internal combustion engine 1, is actuated. In order to be able to provide a valve train as wear-resistant as possible, the sliding tappet 4 has a tungsten carbide- and cobalt-containing coating 6 on a contact surface 5 contacting the cam 3. According to the invention, this coating 6 is applied by means of high velocity oxygen fuel spraying and is subsequently finished, in particular by lapping, and is reduced to a maximum layer thickness of 150 μm.

Prior to the actual application of the tungsten carbide- and cobalt-containing coating 6, a main body 7 of the sliding tappet is blasted, in particular in the region of the contact surface 5, so as to be able to achieve the best possible adhesion of the coating 6. With the coating applied, according to the invention, in the region of the contact surface 5, it is possible to form the main body 7 of sliding tappet from an inexpensive and, in particular, soft steel material.

The coating 6 itself not only has a predefined thickness of maximally 100 μm, but it also has a surface roughness of Rz<2.0. By limiting the surface roughness in such a manner, a particularly low-wear and smooth sliding contact between the cam 3 and the sliding tappet 4 can be achieved. For this purpose, the coating 6 comprises approx. 80 to 90% by weight of tungsten carbide and approx. 10 to 20% of cobalt. Through this, a particularly wear-resistant and hard coating can be achieved.

In general, the sliding tappet 4 manufactured using the method according to the invention can be designed as a flat tappet or flat-bottom tappet, as illustrated in FIG. 1, but also as a mushroom tappet, so that the contact surface 5 has a spherical shape.

With the sliding tappet 4 coated with the coating 6 according to the invention, a sliding tappet 4 can be provided which, on the one hand, is cost-effective and can be manufactured in a simple manner and which, moreover, also withstands the relatively high loads during the sliding contact with the associated cam 3 over a long period of time.

The invention claimed is:

1. A method for manufacturing a sliding tappet of a valve train for an internal combustion engine, comprising:

providing a main body;

applying a coating at least on a contact surface of the main body configured for contacting an associated cam, the coating including tungsten carbide and cobalt;

wherein applying the coating includes a high velocity oxygen fuel spraying technique; and performing a surface finishing on the coating after applying the coating at least on the contact surface, and wherein performing the surface finishing includes lapping the coating with a lapping compound having grains of a homogeneous grain size.

2. The method according to claim 1, wherein performing the surface finishing further includes reducing an initial thickness of the coating to a layer thickness of 150 μm or less.

3. The method according to claim 1, wherein lapping the coating includes forming unsystematic cutting paths of individual grains on a surface of the coating.

4. The method according to claim 1, further comprising blasting at least the contact surface of the main body with a blasting material prior to applying the coating.

5. The method according to claim 4, wherein the blasting material includes at least one of silicon dioxide ($SiO_2$) and corundum.

6. The method according to claim 1, wherein the coating defines a surface roughness Rz of 2.0 μm or less in response to performing the surface finishing.

7. The method according to claim 1, wherein the coating is composed of 80-90% by weight of tungsten carbide and 10-20% by weight of cobalt.

8. A sliding tappet of a valve train for an internal combustion engine, comprising:

a main body defining a contact surface configured to contact an associated cam;

a coating of a high velocity oxygen fuel sprayed material disposed at least on the contact surface of the main body, wherein the coating is composed of 80-90% by weight of tungsten carbide and 10-20% by weight of cobalt; and wherein the coating defines a thickness of 150 μm or less and has a surface roughness Rz of 2.0 μm or less.

9. The sliding tappet according to claim 8, wherein the main body includes at least one of a flat bottom and a spherical bottom, the at least one of the flat bottom and the spherical bottom including the contact surface.

10. The sliding tappet according to claim 8, wherein the thickness of the coating is 100 μm or less.

11. The sliding tappet according to claim 8, wherein the main body includes a spherical bottom and the contact surface is disposed on the spherical bottom.

12. The sliding tappet according to claim 8, wherein the main body is composed of a steel material.

13. An internal combustion engine, comprising:

a sliding tappet and a camshaft in sliding contact with the sliding tappet via a cam, the sliding tappet including a contact surface contacting the cam;

a coating disposed on the contact surface, wherein the coating is a high velocity oxygen fuel sprayed material and composed of 80-90% by weight of tungsten carbide and 10-20% by weight of cobalt; and wherein the coating has a thickness of 150 μm or less and a surface roughness Rz of 2.0 μm or less.

14. The engine according to claim 13, wherein the thickness of the coating is 100 μm or less.

15. The engine according to claim 13, wherein the sliding tappet defines a flat bottom and the contact surface is disposed on the flat bottom.

16. The engine according to claim 13, wherein the sliding tappet includes a spherical bottom and the contact surface is disposed on the spherical bottom.

* * * * *